US006629868B2

(12) United States Patent
Compen

(10) Patent No.: US 6,629,868 B2
(45) Date of Patent: Oct. 7, 2003

(54) METHOD OF MANUFACTURING A CRT

(75) Inventor: Johannes Maria Azalina Antonius Compen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 183 days.

(21) Appl. No.: 09/880,210

(22) Filed: Jun. 13, 2001

(65) Prior Publication Data

US 2001/0053649 A1 Dec. 20, 2001

(30) Foreign Application Priority Data

Jun. 16, 2000 (EP) ..... 00202095

(51) Int. Cl.[7] ..... H01J 9/24

(52) U.S. Cl. ..... 445/23; 445/24; 445/25; 445/27; 445/28; 313/479; 313/481

(58) Field of Search ..... 445/23, 24, 25, 445/27, 28; 427/64, 68; 313/450, 479, 481, 407

(56) References Cited

U.S. PATENT DOCUMENTS 4,151,312 A 4/1979 Compen ..... 427/64
5,366,758 A * 11/1994 Jang

FOREIGN PATENT DOCUMENTS

JP 09167582 6/1997 ..... H01J/29/88

OTHER PUBLICATIONS

Patent Abstracts of Japan 3–71542, Mar. 27, 1991, Cathode–Ray Tube.

* cited by examiner

*Primary Examiner*—Dean A. Reichard
*Assistant Examiner*—Nguyen T. Ha
(74) *Attorney, Agent, or Firm*—Eric Bram

(57) ABSTRACT

A method of manufacturing a cathode ray tube includes arranging the tube with its neck part in a downward position, and covering the inner surface of its funnel-shaped part with a carrier liquid including a conductive material. Carrier liquid is supplied through a pipe positioned near an edge of the funnel-shaped part and close to the inner surface of the funnel-shaped part. The pipe and the funnel-shaped part are moved with respect to each other so that a projection of the pipe on the inner surface describes a trajectory on the inner surface of the funnel-shaped part which is substantially parallel to the edge of the funnel-shaped part, thus allowing the carrier liquid to drain downwardly, thereby leaving a coating formed by a residue of the conductive material on the inner surface. During the covering step, the pipe and the funnel-shaped part are moved with respect to each other to describe a non-closed loop trajectory, such that a high-voltage connection element is not completely coated.

5 Claims, 3 Drawing Sheets

METHOD OF MANUFACTURING A CRT

BACKGROUND AND SUMMARY

The invention relates to a method of manufacturing a cathode ray tube, said cathode ray tube comprising a funnel-shaped part connected to a neck part, the funnel-shaped part having an inner surface and a high-voltage connection element, the method comprising the steps of: arranging the tube with its neck part in a downward position, covering the inner surface of the funnel-shaped part with a carrier liquid comprising a conductive material, the covering step comprising: supplying the carrier liquid through a pipe positioned near an edge of the funnel-shaped part and close to the inner surface of the funnel-shaped part, the pipe and the funnel-shaped part being moved with respect to each other, a projection of the pipe on the inner surface thereby describing a trajectory on the inner surface of the funnel-shaped part which is substantially parallel to the edge of the funnel-shaped part, and allowing the carrier liquid to drain downwardly, thereby leaving a coating formed by a residue of the conductive material on the inner surface. The invention also relates to a device for manufacturing a cathode ray tube U.S. Pat. No. 4,151,312, issued on Apr. 24, 1979, describes a method of manufacturing a cathode ray tube (CRT) by providing an electrically conductive coating on an inner surface of a funnel-shaped part of the tube. A suspension comprising a conductive material flows from a container through a pipe which discharges on the inner surface of the funnel-shaped part and hits said surface approximately below an edge of the funnel-shaped part. The pipe is moved along the edge of the funnel-shaped part until the inner surface is covered everywhere with a uniformly thick layer of the suspension. The wet suspension is subsequently dried.

This way of providing the coating has the disadvantage that also the high-voltage connection element comprised on the funnel-shaped part becomes completely covered with the coating. After the coating step, a so-called getter spring is attached to the high-voltage connection element. If the high-voltage connection element and an area around it are not completely clean, then this assembling step may introduce unwanted loose particles from the coating into the tube. Consequently, the high-voltage connection element has to be cleaned prior to the connection of the getter spring. This requires an additional process step. Such a cleaning step has to be done extremely well to prevent loose particles from being further introduced into the tube.

It is an object of the invention to provide a method and a device for manufacturing a CRT that does not require an additional cleaning step after the coating step. To this end, the invention is characterized in that, during the covering step, the pipe and the funnel-shaped part are moved with respect to each other to obtain a which is a non-closed loop, such that the high-voltage connection element is not completely provided with the coating.

This way of providing the coating leaves the high-voltage element uncovered so that no further cleaning steps are required. As a consequence, no loose particles from a coating area around the high-voltage connection element can be generated. Thus, the manufacturing yield of the tube is improved and the cost price of the product is reduced.

Advantageous embodiments of the invention are defined in the dependent claims.

It is to be noted that JP-A 3-71542, published on Mar. 27, 1991, discloses a cathode ray tube, which is provided with a conductive film that is applied to the inner wall surface of a funnel, except for an inner portion of an anode button terminal provided on the inner wall surface, a nipple portion and near an inner portion of the terminal. Thus, a high-voltage applied to the terminal is transmitted and supplied to the whole of the film by the contact of a getter supporting metal plate, the plate extending from the nipple portion. The film is prevented from peeling off due to the contact and vibration of the junction point of the nipple point with the metal plate and the withstand property of the cathode ray tube is enhanced so that a stable image is obtained. However, this document is silent on how the conductive film is applied in such a manner that the inner portion of the anode button terminal is excepted.

DESCRIPTION OF THE DRAWING FIGURES

These and other aspects of the invention will be elucidated with reference to the embodiments described hereinafter.

In the drawings.

In general, like reference numerals identify like elements.

DETAILED DESCRIPTION

Figure 1:
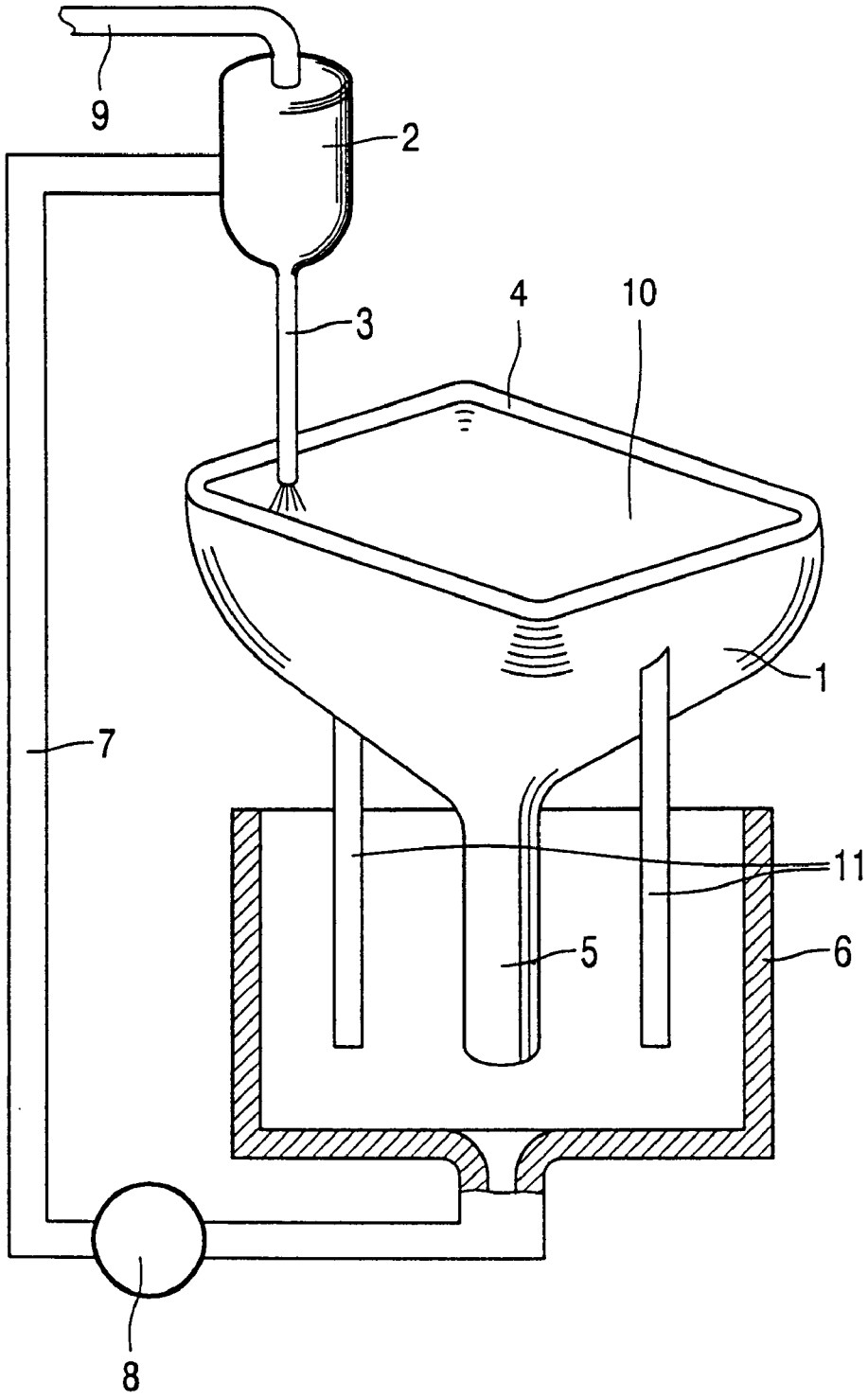
FIG. 1 illustrates the method of providing a coating on the inner side of the funnel-shaped part according to the invention.

FIG. 1 illustrates the method of providing the coating according to the invention. The cathode ray tube is positioned with the neck part oriented downward. The inner surface of the funnel-shaped part is covered with a carrier liquid comprising a conductive material. The carrier liquid comprises, for example, a suspension of 10–20% by weight of graphite powder as conductive material, approximately 20% by weight of water-glass consisting of a 20% solution of $K_2O$ and $SiO_2$ in the ratio of 1:3.5, approximately 1% of an organic binder, for example, polyvinylpyrrolidon and approximately 60% by weight of water. Good results were obtained with such a carrier liquid. However, the invention is not restricted to a carrier liquid having the composition described above. The method also works satisfactorily with carrier liquids having a different composition.

For the covering step, the carrier liquid is supplied through a pipe 3 positioned near an edge 4 of the funnel-shaped part and close to the inner surface of the funnel-shaped part. The carrier liquid flows from a container 2 through the pipe 3, which discharges on the inner surface 10 of the funnel-shaped part 1 and hits the surface at approximately 1 cm below the edge 4 of the funnel-shaped part. The pipe 3 may be provided with a nozzle for guiding the carrier liquid and making a well-defined angle with the inner surface of the funnel-shaped part. The pipe 3 is moved along the edge of the funnel-shaped part 1 until the inner surface, apart from an area around the high-voltage connection element, is covered with a layer of the suspension having a uniform thickness. Instead of moving the pipe 3, it is alternatively possible to rotate the funnel-shaped part 1 about a longitudinal axis e.g. by means of a moving unit, the outflow aperture of the pipe being always kept at a fixed distance from the edge 4 of the funnel-shaped part. During the movement of the pipe, a downward projection of the pipe on the inner surface describes a trajectory on the inner surface of the funnel-shaped part that is substantially parallel to the edge of the funnel-shaped part. The carrier liquid is allowed to drain downwardly, thereby leaving a coating formed by a residue of the conductive material on the inner surface. The excess suspension flows through the neck 5 into a reservoir 6 and is pumped by means of a pump 8 back into the container 2 through a return duct 7. The level of the suspension in the container 2 is further maintained through a duct 9. The funnel-shaped part 1 is supported by four supporting members 11, two of which are shown. The required precision of the positioning and movement of the pipe 3 can be easily established with a very high accuracy by connecting the pipe to e.g. an arm of a manufacturing robot. The relative movement of the pipe 3 with respect to the funnel-shaped part 1 can also be established by rotation of the funnel-shaped part around its longitudinal axis by means of a motor.

After the coating step, the wet suspension 13 may be dried by means of a number of infrared lamps or by a flow of warm air.

Figure 2:
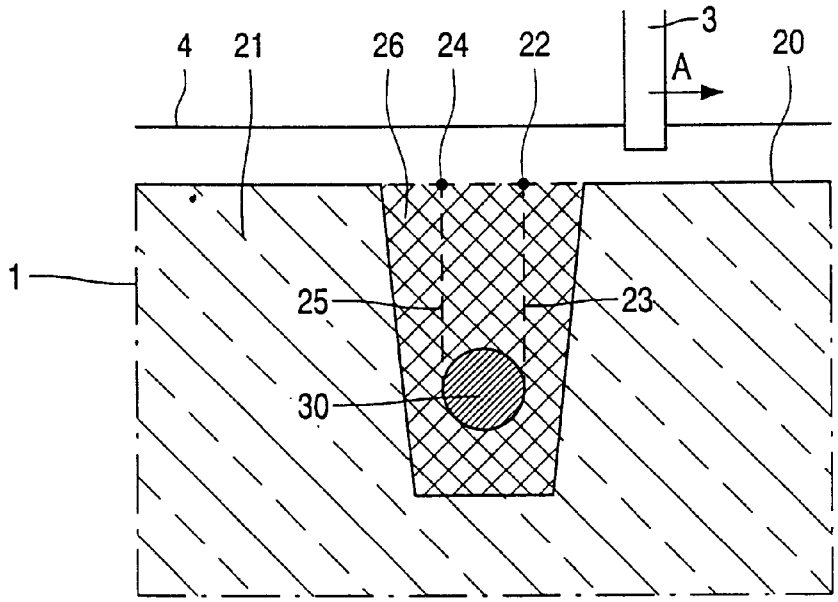
FIG. 2 shows a funnel-shaped part provided with a coating according to the invention.

FIG. 2 shows a funnel-shaped part provided with a coating 21 according to the invention. An area 26 of the inner surface around the high-voltage connection element 30 is not provided with the coating. This uncoated area 26 is obtained as follows. During the movement of the pipe 3, a projection of the pipe on the inner surface describes a trajectory 20 on the inner surface of the funnel-shaped part 1 that is substantially parallel to the edge 4 of the funnel-shaped part. A projection of the high-voltage connection element 30 on the trajectory 20, indicated by dashed lines 23 and 25 in the Figure, has first and second intersection points 22, 24. In operation, a high-voltage is externally applied to the high-voltage connection element 30 and this voltage is passed via the high-voltage element 30 and a so-called getter spring to the coating.

When the coating process is started, the pipe 3 is located at a starting position on one side of the first projection 22, such that, when the pipe is moved into the direction A, the carrier liquid does not cover the first intersection point 22. After having completed a substantial part of the trajectory, the movement of the pipe is stopped at a side of the second intersection point 24, while the second intersection point 24 is not covered by the carrier liquid. The trajectory thus forms a non-closed loop, and an area 26 around the high-voltage element 30 remains uncovered by the coating.

Conventionally, during the coating process, the high-voltage connection element 30 and the area 26 around it become completely covered with the coating. Especially, this part of the coating easily generates loose particles, when the coating becomes damaged in further manufacturing steps. Such a further manufacturing step is, for example, the connection of the getter spring to the high-voltage connection element 30. The getter spring allows a high potential to be passed to the electrically conductive layer. The coating around the high-voltage connection element easily crumbles away when assembling the spring to the high-voltage element. Such crumbled particles may be left in the tube and cause high-voltage problems. Furthermore, these particles may contaminate parts of an electron gun, which is used for generating electron beams. When the gun parts are at different voltages, undesired, high-voltage phenomena may occur. Conductive particles left on what should be the uncovered part of the tube are a drawback, when the conductive coating has applied to it a potential of a few tens of kilovolts during operation of the tube because unwanted phenomena, such as electrical flashovers may occur.

Therefore, in the manufacture of conventional tubes, an additional cleaning step for cleaning the high-voltage connection element 30 and an area around this element is required. However, such an additional cleaning step may also generate unwanted loose particles. The manufacturing process according to the invention eliminates such loose particles, in view of the area 26 being uncoated.

Figure 3:
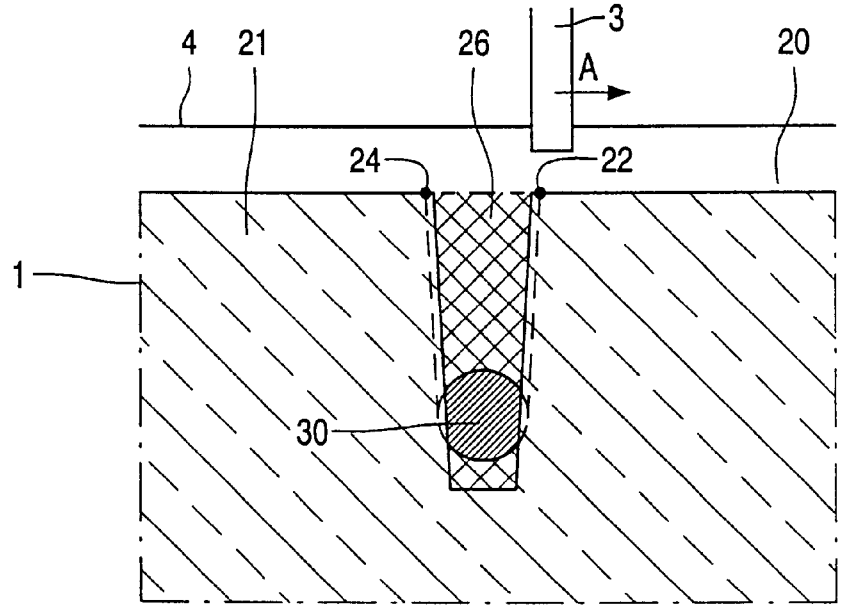
FIG. 3 shows a connection between the high-voltage connection element in accordance with a first embodiment of the invention.

A further embodiment of the invention is shown in FIG. 3. An electric connection between the high-voltage connection element 30 and the conductive coating may be provided by the coating itself. This is realized by choosing the start and the end point of the trajectory to be such that the coating partly overlaps with the high-voltage connection element. Present precision robots are able to position the pipe very accurately. This embodiment has the advantage that no additional process steps or any additional connection elements for establishing the electric connection are required. This further reduces the cost price of the tube.

Figure 4:
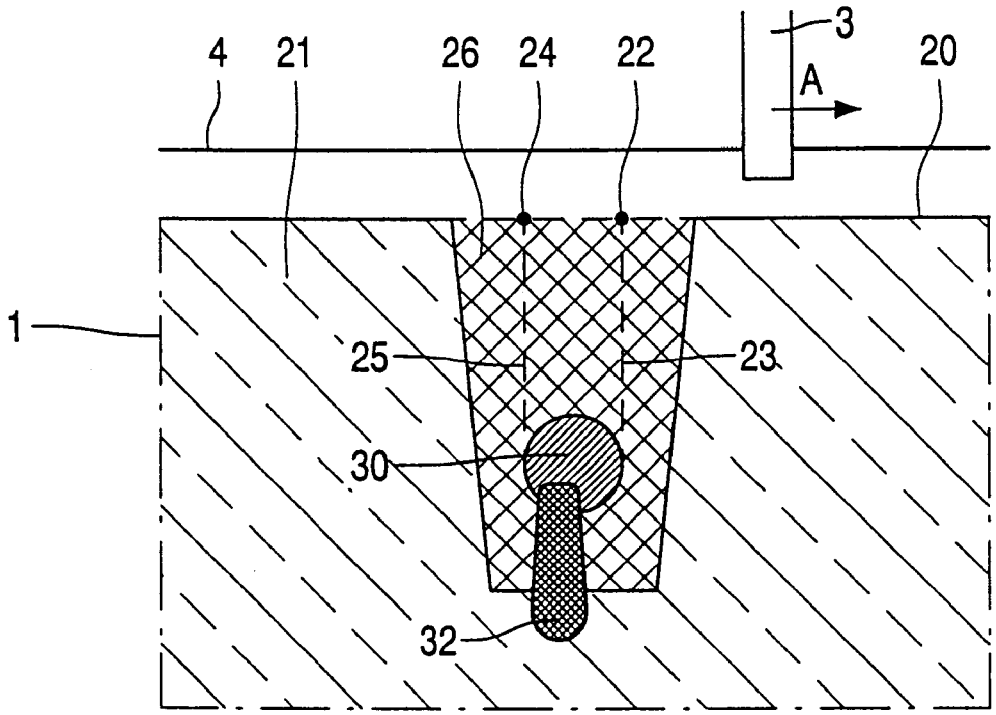
FIG. 4 shows a connection between the high-voltage connection element in accordance with a second embodiment of the invention.

A further embodiment is shown in FIG. 4, wherein the electric connection is provided by means of an additional covering step performed by the pipe, the additional coating 32 thus formed extending from the high-voltage element to the coating. FIG. 4 shows that an additional stripe of coating 32 provides the electric contact between the coating 21 and the high-voltage connection element 30. The additional stripe 32 is made by moving the pipe 3 to the high-voltage connection element 30 and allowing a flow of an additional layer of carrier liquid. The application of this additional process step can be performed after or before the application of the coating layer 21. The required precision of the positioning and movement of the pipe 3 can be easily established with a very high accuracy by connecting the pipe to e.g. an arm of a manufacturing robot.

In summary, the invention relates to a method of manufacturing a cathode ray tube comprising a funnel-shaped part 1 connected to a neck part 5, the funnel-shaped part having an inner surface and a high-voltage connection element 30. The manufacturing method comprises the step of covering the inner surface of the funnel-shaped part 1 with a carrier liquid comprising a conductive material. The covering step comprises: supplying the carrier liquid through a pipe 3 positioned near an edge 4 of the funnel-shaped part and close to the inner surface of the funnel-shaped part 1. The pipe and the funnel-shaped part are moved with respect to each other, while a projection of the pipe on the inner surface thereby describes a trajectory 20 on the inner surface of the funnel-shaped part which is substantially parallel to the edge 4 of the funnel-shaped part. The carrier liquid is allowed to drain downwardly, and thereby leaves a coating 26 formed by a residue of the conductive material on the inner surface. During the covering step the pipe 3 and the funnel-shaped part 1 are moved with respect to each other to obtain a trajectory 20 which is a non-closed loop, such that the high-voltage connection element 30 is not completely provided with the coating 26.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim.

What is claimed is:

1. A method of manufacturing a cathode ray tube including a funnel-shaped part connected to a neck part, the tunnel-shaped part having an inner surface and a high-voltage connection element, by arranging the tube with its neck part in a downward position and covering the inner surface of the funnel-shaped part with a carrier liquid comprising a conductive material, the method comprising:

supplying the carrier liquid through a pipe positioned near an edge of the funnel-shaped part and close to the inner surface of the funnel-shaped part;

moving the pipe and the funnel-shaped part with respect to each other to obtain a first trajectory which is a non-closed loop, a projection of the pipe on the inner surface thereby describing a second trajectory on the inner surface of the funnel-shaped part which is substantially parallel to the edge of the funnel-shaped part, and allowing the carrier liquid to drain downwardly, thereby leaving a coating formed by a residue of the conductive material on the inner surface, the first trajectory being such that the high-voltage connection element is not completely provided with the coating.

2. A method of manufacturing a cathode ray tube as claimed in claim 1, wherein an electric connection between the high-voltage connection element and the coating is provided.

3. A method of manufacturing a cathode ray tube as claimed in claim 2, wherein the electric connection is provided by the coating itself, a start and an end point of the first trajectory being chosen to be such that the coating partly overlaps with the high-voltage connection element.

4. A method of manufacturing a cathode ray tube as claimed in claim 2, wherein the electric connection is provided by means of an additional covering step performed by the pipe, the additional coating thus formed extending from the high-voltage element to the coating.

5. A device for manufacturing a cathode ray tube including a funnel-shaped part connected to a neck part, the funnel-shaped part having an inner surface and a high-voltage connection element, by arranging the tube with its neck part in a downward position and covering the inner surface of the funnel-shaped part with a carrier liquid comprising a conductive material, comprising:

means for supplying the carrier liquid through a pipe positioned near an edge of the funnel-shaped part and close to the inner surface of the funnel-shaped part;

means for moving the pipe and the funnel-shaped part with respect to each other to obtain a first trajectory which is a non-closed loop, a projection of the pipe on the inner surface thereby describing a second trajectory on the inner surface of the funnel-shaped part which is substantially parallel to the edge of the funnel-shaped part, and means for allowing the carrier liquid to drain downwardly, thereby leaving a coating formed by a residue of the conductive material on the inner surface, the first trajectory being such that the high-voltage connection element is not completely provided with the coating.

* * * * *